US009822328B2

(12) United States Patent
Desai et al.

(10) Patent No.: US 9,822,328 B2
(45) Date of Patent: Nov. 21, 2017

(54) CLEANER FOR GREASE REJUVENATION AND METHOD OF MAINTAINING BEARINGS, BUSHINGS, LINKAGE PINS, AND CHAINS

(71) Applicant: Electric Power Research Institute, Inc., Charlotte, NC (US)

(72) Inventors: Bhavin N. Desai, Concord, NC (US); Robert H. Kinner, Twinsburg, OH (US); John W. Harley, Peninsula, OH (US); Corbin Moon, Canton, OH (US); Michael A Lebow, Yardley, PA (US)

(73) Assignee: ELECTRIC POWER RESEARCH INSTITUTE, INC., Charlotte, NC (US)

( * ) Notice: Subject to any disclaimer, the term of this patent is extended or adjusted under 35 U.S.C. 154(b) by 460 days.

(21) Appl. No.: 14/307,765

(22) Filed: Jun. 18, 2014

(65) Prior Publication Data

US 2015/0068555 A1 Mar. 12, 2015

Related U.S. Application Data

(60) Provisional application No. 61/876,879, filed on Sep. 12, 2013.

(51) Int. Cl.

| | |
|---|---|
| ***C11D 3/20*** | (2006.01) |
| ***C11D 1/72*** | (2006.01) |
| ***C11D 3/37*** | (2006.01) |
| ***C11D 3/43*** | (2006.01) |
| ***C11D 11/00*** | (2006.01) |
| *C11D 3/16* | (2006.01) |

(52) U.S. Cl.
CPC ..... *C11D 3/2072* (2013.01); *C11D 1/72* (2013.01); *C11D 3/373* (2013.01); *C11D 3/43* (2013.01); *C11D 11/0041* (2013.01); *C11D 3/162* (2013.01)

(58) Field of Classification Search
CPC ..... C11D 7/50
See application file for complete search history.

(56) References Cited

U.S. PATENT DOCUMENTS

| | | | | |
|---|---|---|---|---|
| 5,780,412 | A * | 7/1998 | Scarborough | C04B 41/009 106/287.12 |
| 5,866,005 | A * | 2/1999 | DeSimone | B08B 3/12 134/10 |
| 6,974,605 | B2 * | 12/2005 | Macris | B05D 5/00 427/402 |
| 8,013,023 | B2 * | 9/2011 | Hastwell | G03G 9/12 516/20 |
| 2003/0228997 | A1 * | 12/2003 | Doyel | C11D 7/509 510/410 |
| 2014/0272148 | A1 * | 9/2014 | Phang et al. | C11D 3/373 427/331 |
| 2015/0038391 | A1 * | 2/2015 | De Wit | C11D 11/0023 510/238 |

* cited by examiner

*Primary Examiner* — Gregory Webb
(74) *Attorney, Agent, or Firm* — Trego, Hines & Ladenheim, PLLC

(57) ABSTRACT

A cleaner and method for maintaining bearings, bushings, linkage pins and chains used in various types of machinery, including industrial machinery is disclosed. The cleaner is effective to rejuvenate spent grease and includes a polar fraction, a miscible non-polar fraction, and a non-ionic surface activating agent.

7 Claims, 6 Drawing Sheets

CLEANER FOR GREASE REJUVENATION AND METHOD OF MAINTAINING BEARINGS, BUSHINGS, LINKAGE PINS, AND CHAINS

BACKGROUND OF THE INVENTION

This application relates to a cleaner and method of use and, more particularly, to a cleaner and method for maintaining bearings, bushings, linkage pins and chains used in various types of machinery, including industrial machinery. Circuit breakers and switchgear mechanisms, discussed below, are used as examples only of machines that consist of many types of ball, roller, sleeve and bushing-type bearings and chains.

Circuit breakers, such as high voltage and medium voltage circuit breakers, are used in electrical transmission systems to protect electrical circuits from damage caused by overloads or short circuits. The circuit breakers include mechanisms that allow movement of a switch to interrupt the transmission of electricity therethrough. These mechanisms, example shown in FIG. 1 at reference numeral 10, include multiple bearings and joints to allow the switch to move easily and in a preferred amount of time.

Because circuit breakers are used to prevent damage caused by overloads or short circuits, it is important that the mechanism 10 operate properly and quickly. As the lubricant or grease in the mechanism ages, it dries up leaving a crusty residue that slows or prevents operation of the mechanism. As a result, the mechanism and its bearings must be properly maintained to prevent slow operation. Proper maintenance requires the bearings and bushings of the mechanism to be cleaned and lubricated regularly to renew the lubricants.

Unfortunately, the mechanisms 10 are not manufactured with grease fittings, which are common on most equipment requiring grease lubrication, to allow for maintenance on the bearings and bushings. As shown in FIG. 2, some bearings and bushings are easily accessed for maintenance, but, as shown in FIGS. 3 and 4, other bearings and bushings are very difficult to access. As a result of this access problem, cleaning and lubrication of critical locations is impossible without substantial mechanism disassembly which is often very difficult, requires skilled workers and considerable time, is costly, impractical because of worker availability and outage schedules for equipment, and in some cases results in these mechanisms not being maintained at normal maintenance intervals.

Discussions with utility companies indicate oils with penetrants are often used as: (1) a first line of response when there is a slow trip, (2) routine lubricant for the breaker mechanism when other maintenance is being performed, (3) life extension measure, (4) method to free stuck components, and (5) cleaner. Laboratory tests demonstrate that oils with penetrants partially dissolve grease, which then coagulates again after the solvent in the penetrant evaporates.

Accordingly, there is a need for a cleaner and method that prevents grease from coagulating after solvents evaporate. This extends the interval between conventional mechanism re-lubrications and reduces the number of slow trips caused by lubrication issues.

BRIEF SUMMARY OF THE INVENTION

These and other shortcomings of the prior art are addressed by the present invention, which provides a cleaner or solvent, and its use, that improves the efficacy of cleaning without coagulation of grease thickeners; thereby, increasing the success rate of rejuvenating spent grease in a bearing.

According to one aspect of the invention, a cleaner effective to rejuvenate spent grease includes a polar fraction, a miscible non-polar fraction, and a non-ionic surface activating agent.

According to another aspect of the invention, a cleaner effective to rejuvenate spent grease includes, by approximate weight percent, 40%-90% silicone, 10%-50% acetone, trace—5% alkylphenol ethoxylate, or trace—5% polymethylated primary alcohol.

According to another aspect of the invention, a method for maintaining bearings, bushings, linkage pins and chains used in various types of machinery includes the steps of providing a cleaner consisting essentially of a polar fraction, a miscible non-polar fraction, and a non-ionic surface activating agent. The method further includes the steps of applying the cleaner to a joint of a piece of machinery, applying oil to the joint, testing the joint to ensure proper timing, and repeating steps (a) through (d) if necessary.

BRIEF DESCRIPTION OF THE INVENTION

The subject matter that is regarded as the invention may be best understood by reference to the following description taken in conjunction with the accompanying drawing figures in which.

DETAILED DESCRIPTION OF THE INVENTION

The present invention incorporates a new cleaner formulation and its use that stabilizes the grease thickeners, varnishes, and other debris that may be slowing or locking the bearing. The particles treated with this specialized cleaner form a stable colloid after miscible oil is added.

Figure 1:
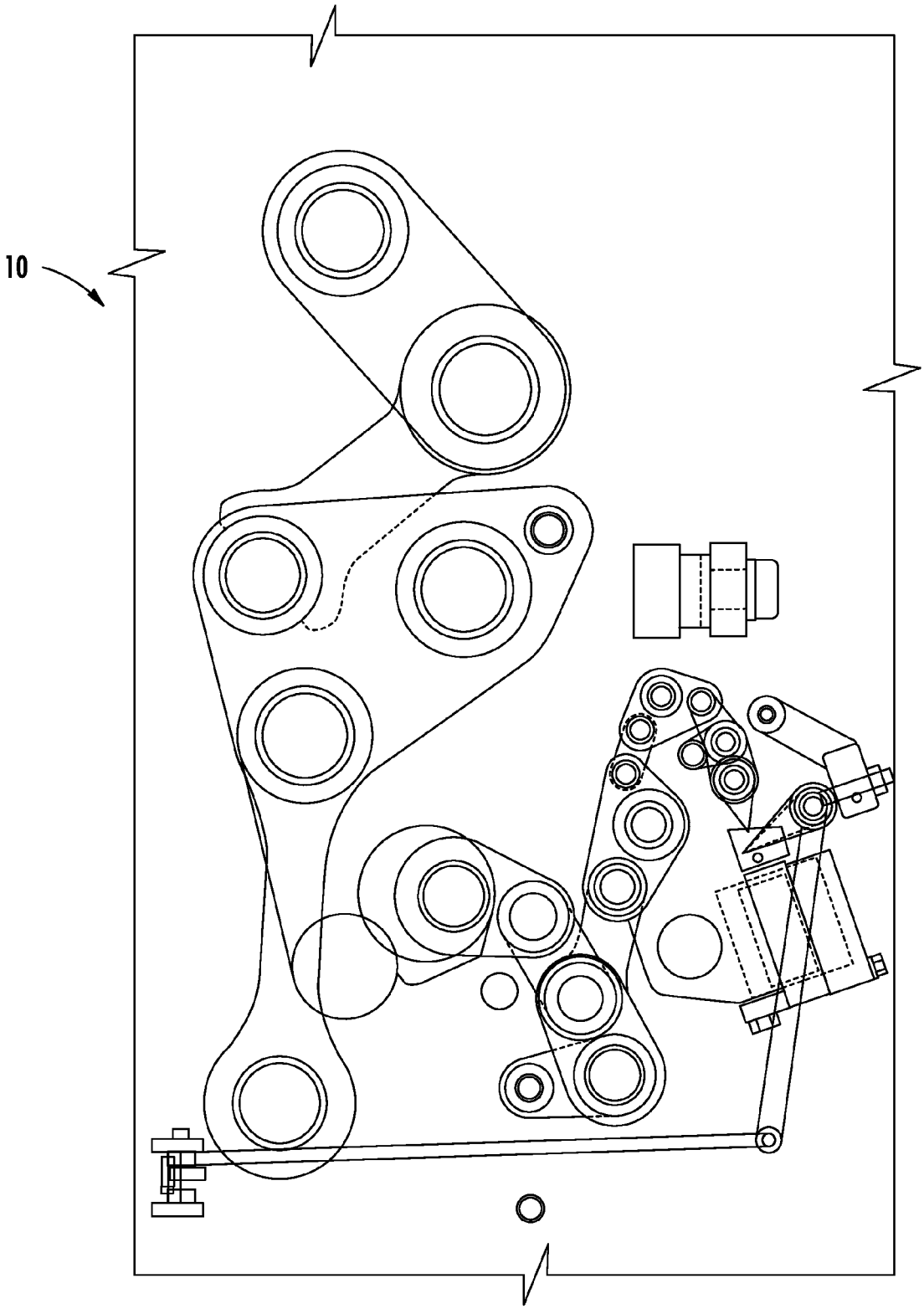
FIG. 1 shows an example circuit breaker mechanism.
Figure 2:
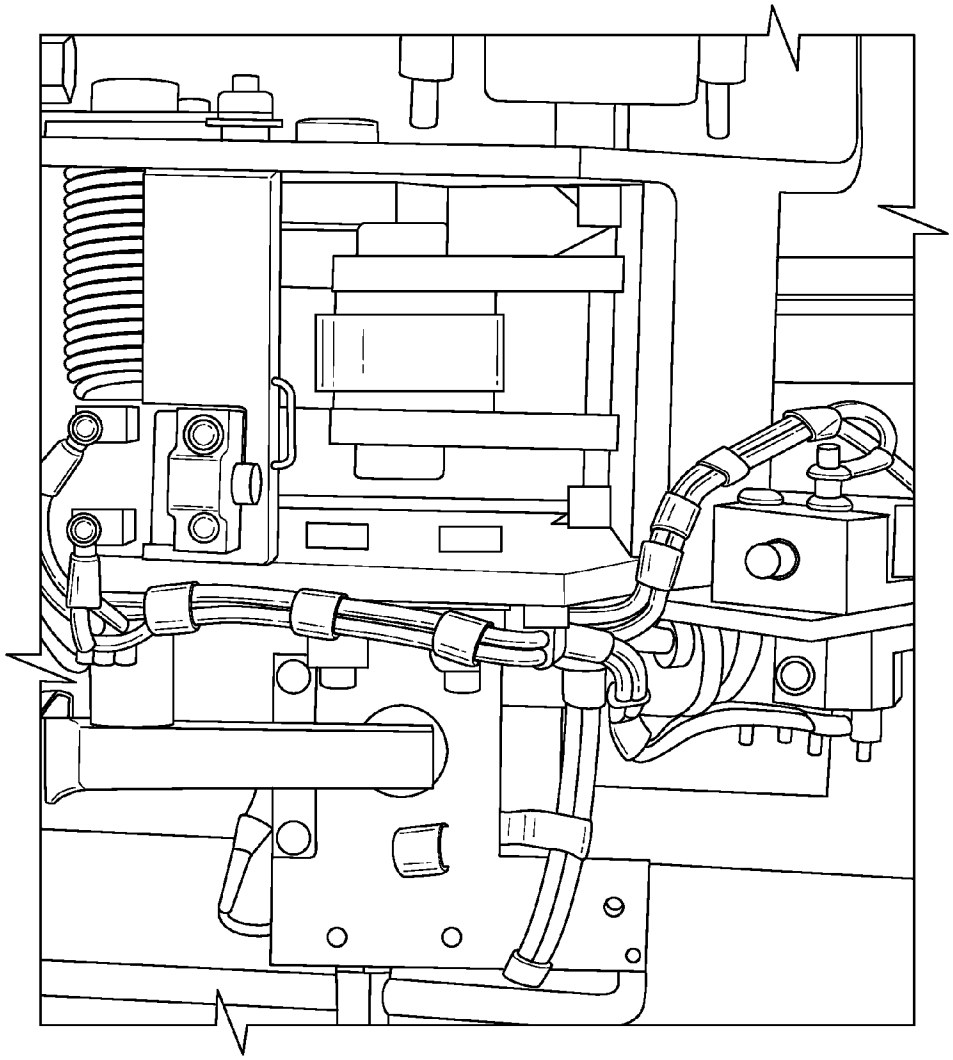
FIG. 2 shows accessible bearings and bushings of a circuit breaker mechanism.
Figure 3:
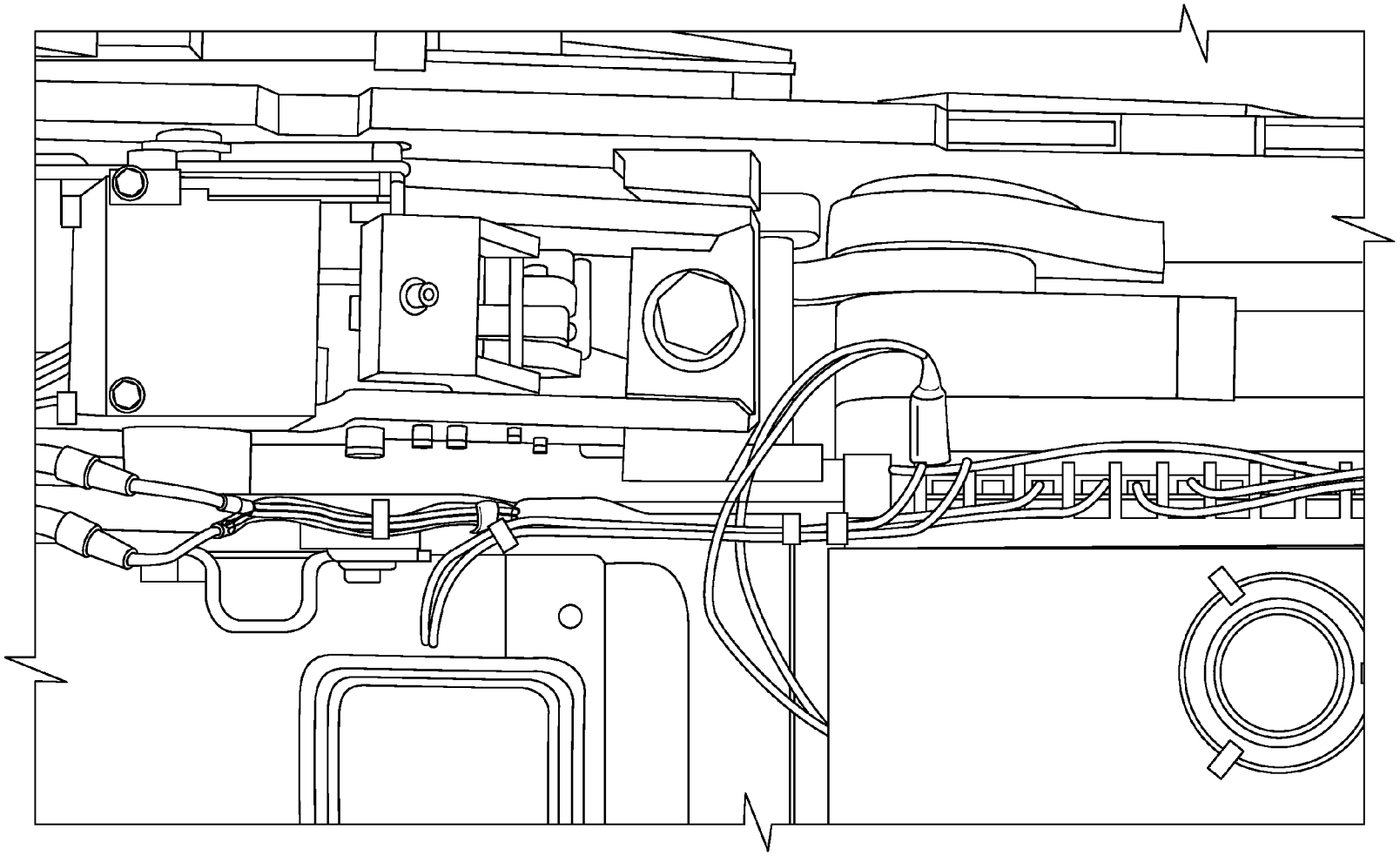
FIGS. 3 and 4 show inaccessible bearings and bushings of a circuit breaker mechanism.
Figure 4:
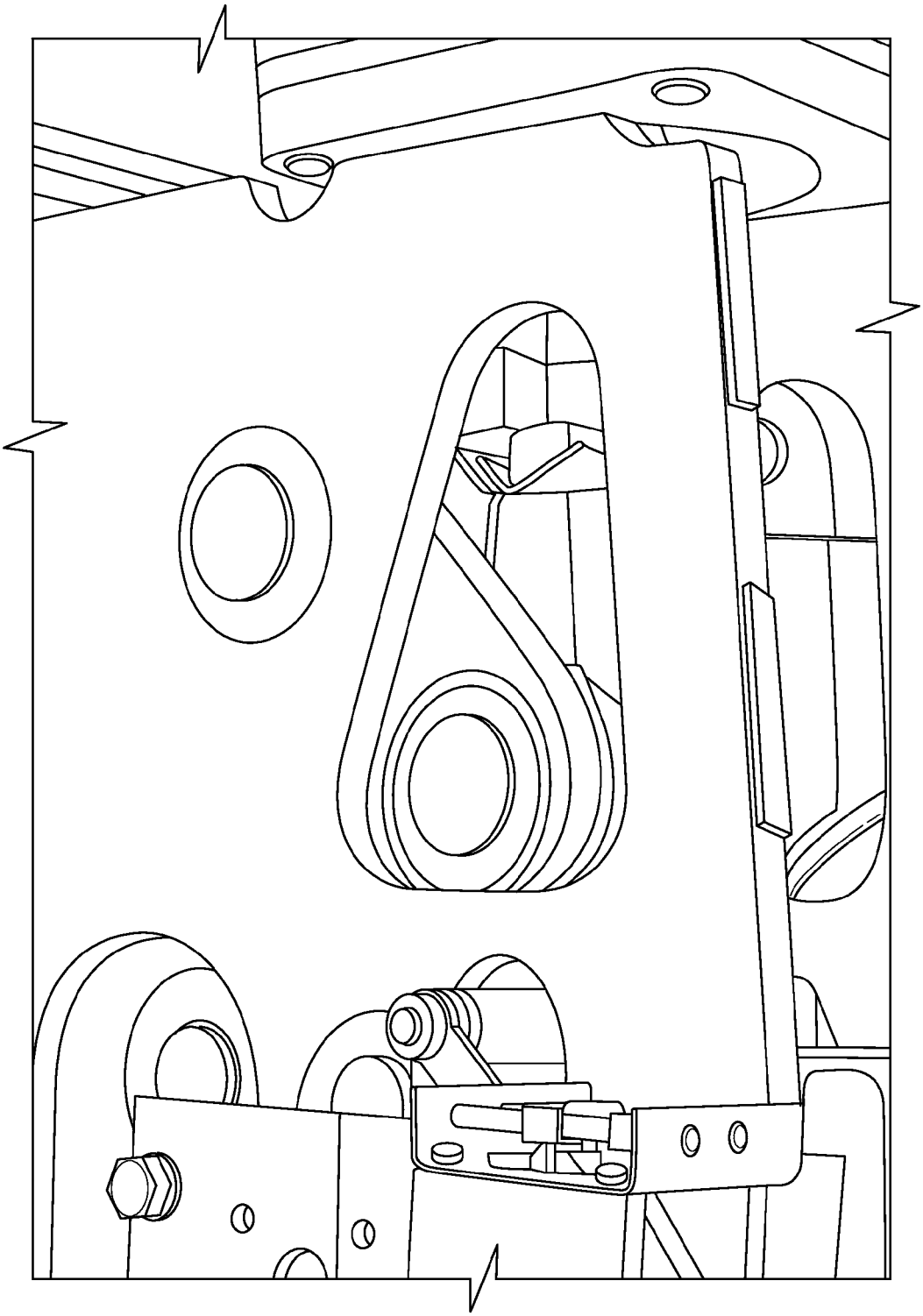
Figure 5:
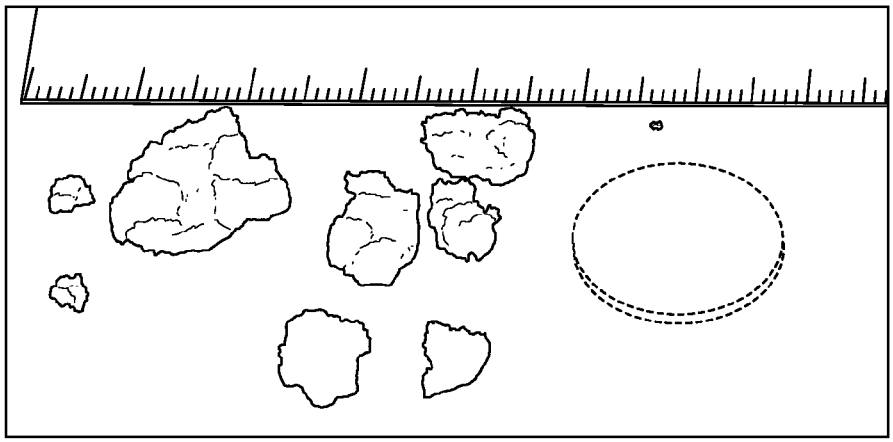
FIGS. 5-7 show coagulation of grease thickeners.
Figure 6:
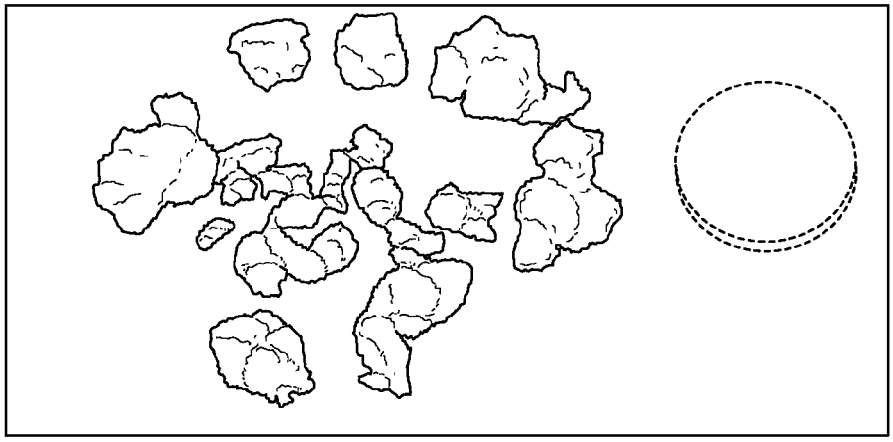
Figure 7:
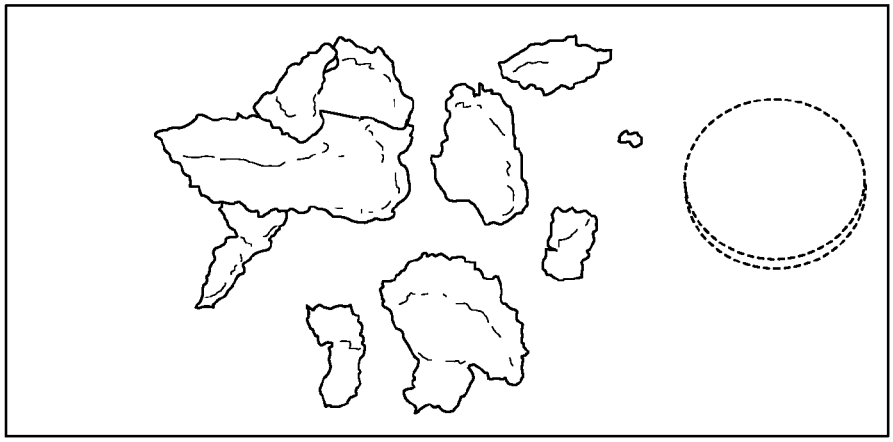
Figure 8:
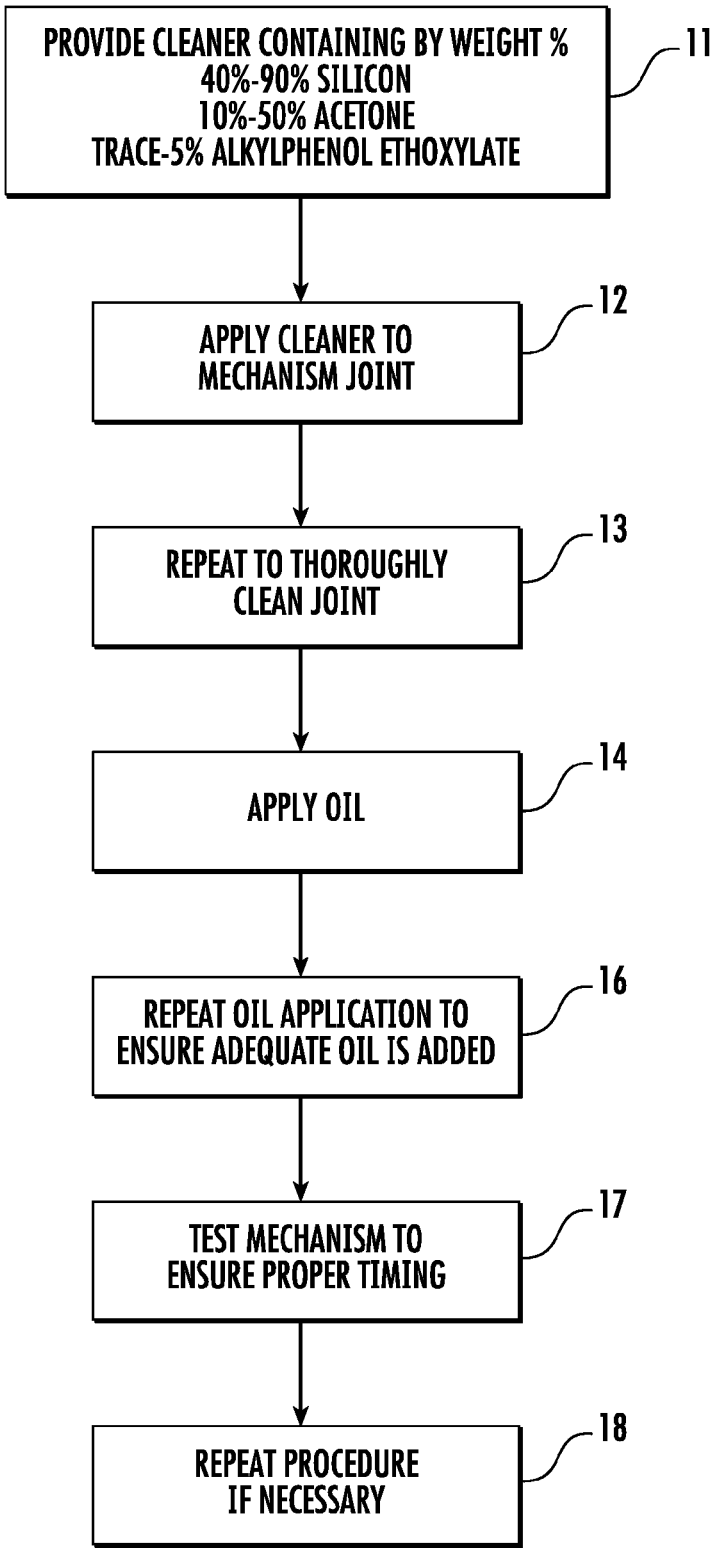
FIGS. 8 illustrates a method for cleaning a mechanism having bearings and bushings.

As the grease ages in a bearing, failures occur due to the oil bleeding out, drying up, and/or oxidizing. Oxidation causes oils to become gummy. Evaporation of the oil and separation of the oil from the grease leave thickeners in a dry immovable state. The end result is a crusty residue, comprised of grease thickener and oxidation byproducts, which slows or prevents the operation of the bearing. Commercial degreasers remove the oil and oxidation byproducts, but destabilize the grease thickeners, leading to coagulation. See FIGS. 5-7. Coagulation inhibits the ability of the grease to uptake new oil.

The lubrication of circuit breaker mechanisms is often addressed by exercising the mechanism, spraying the mechanism with a general purpose penetrant and lubricant, or a combination of both. For purposes of this application, penetrating oil is defined as a light hydrocarbon distillate or surfactant that reduces the surface tension of oil to allow the oil to travel into tight spaces quickly by pulling the oil into the spaces through diffusion. The effectiveness is limited and, based on laboratory testing, these methods are only effective for a few hours. Some users spray bearings and bushings with degreaser and then spray or pour lubricating oil over the mechanism. The use of general purpose sprays and exercising of the mechanism are commonly performed; however, their effectiveness in the field is not consistent in terms of repeatable performance and long lubricant life.

Based on testing, several observations were made.

Penetrating oil loosens oxidized grease and provides an initial improvement in operation time; however, by the next morning slow operation time reoccurs. Sprays used on bearings with aged grease may not "free" the bearing for operation for more than 12 hours.

Renewing Grease—Cannot pour oil onto old thickener and get original grease. Varnishes remain in the system, which inhibit movement.

Sealed Ball Bearings—Must use oil with a substantial amount of penetrant due to inability of even light oil to go past the bearing seal.

Synthetic oil with penetrant is effective and provides longer life than aerosols. Aerosol propellants do not provide better penetration of tight bearing clearances —only penetration effectiveness factor is interfacial tension. Many aerosols contain petroleum oils that are solid or thickening at −18° C. (0° F.).

Long-life synthetic oils are too viscous to form an aerosol without being diluted with significant amounts of solvent. This limits the amount of lubricating oil which can be brought into the system.

Sleeve Bearings—If there is shim protecting the bearing from dirt, cleaner/degreaser must be used before lubricant is applied. Multi-step process of degreaser and oil produces significantly better results. Many degreasers leave residue even though label says not.

The new cleaner improves the efficacy of cleaning without coagulation of the thickeners; thereby, increasing the success rate of rejuvenating spent grease in a bearing. The cleaner consists of a polar fraction, such as acetone, a miscible non-polar fraction, such as silicone cleaner, and a non-ionic surface activating agent, such as an alkylphenol ethoxylate or polymethylated primary alcohol. An example formulation, by approximate weight percent, includes about 40%-90% silicone (MW<1000), 10%-50% Acetone, trace—5% alkylphenol ethoxylate, or trace—5% polymethylated primary alcohol Block 11. The formulation contains no VOC's as defined by the Environmental Protection Agency.

It was found through experimentation that the mixed polarity solvent of the current invention (silicone +acetone along with a non-ionic activating agent −alkylphenol ethoxylate or polymethylated primary alcohol) was very effective in removing spent oil or grease and, along with the steps below, improved the trip time of mechanical devices, such as circuit breakers. For the experiment, several solvents were chosen based on their solvent classification. Five classifications were chosen.

Non-Polar—a solvent whose molecules contain no net dipole.

Semi-Polar—a molecule which contains no net dipole, but does contain local polarities.

Polar Proctic—a solvent whose molecules contain a net dipole and has the ability to release a proton in solution.

Polar Aprotic—a solvent whose molecules contain a net dipole, and does not release protons in solution.

Mixed Polarity—a mixture of solvents or a solvent dissolved in another solvent.

The majority of synthetic greases used utilize a Polyalphaolefin (PAO) oil. These include greases such as Mobil 28, Mobilith SHC, and Kluber L152. Other common grease selections utilize petroleum base oils.

To model oxidized oil from an end of life grease, synthetic PAO oil was oxidized on a hot plate for several hours until it formed into a brown, sticky gel. For each test solvent, approximately 70 mg of oxidized PAO oil was placed in a beaker. The beaker was filled with 40 mL of the specified solvent and stirred rigorously for several minutes. The excess solvent was decanted out. The beaker was placed in an oven for 15 minutes to evaporate any residual solvent. The new weight was recorded. The results are presented in Table 1 below.

TABLE 1

| Solvent | Classification | VOC Status | Empty Beaker (g) | Before Cleaning (g) | After Cleaning (g) | Oxidized Oil (g) | Oil Removed (g) | Removal Rate (%) |
|---|---|---|---|---|---|---|---|---|
| Pentane | Non-Polar | VOC | 28.8793 | 28.971 | 28.902 | 0.0917 | 0.069 | 75.25 |
| Acetone | Polar Aprotic | Non-VOC | 29.4635 | 29.535 | 29.521 | 0.0715 | 0.014 | 19.58 |
| OS-2 | Semi-Polar | Non-VOC | 29.0489 | 29.115 | 29.056 | 0.0661 | 0.059 | 89.26 |
| Isopropanol | Polar Protic | Non-VOC | 29.623 | 29.6943 | 29.6802 | 0.0713 | 0.0141 | 19.78 |
| Naphtha | Semi-Polar | VOC | 29.3769 | 29.453 | 29.396 | 0.0761 | 0.057 | 74.90 |
| OS-2 + Acetone | Mixed Polarity | Non-VOC | 28.6365 | 28.7144 | 28.639 | 0.0779 | 0.0754 | 96.79 |
| OS-2 + Isopropanol | Mixed Polarity | Non-VOC | 30.3298 | 30.4196 | 30.36 | 0.08980 | 0.0596 | 66.37 |
| TRUE BLITZ | Mixed Polarity | VOC | 29.2365 | 29.2975 | 29.2701 | 0.061 | 0.0274 | 44.92 |

As opposed to the prior art methods of disassembling the mechanisms to clean and lubricate the bearings, the cleaner of the present invention allows a user to clean and lubricate the bearing by injecting the cleaner onto the mechanism and following the cleaner with a long life, low interfacial tension oil to obtain long lasting results without disassembly of the mechanism. The current method allows the mechanism to operate with performance and life comparable to applying new grease/lubricant without the need to take the mechanism apart.

In use, the cleaner is injected onto or into the joint of the mechanism multiple times to dissolve grease oxidation byproducts and fluidize the grease. The cleaner is drawn into the bearing or bushing by capillary action. The ability of the cleaner to flush out oxidation byproducts is limited by the clearance between moving parts. The cleaner is applied in short spurts, allowing time for the joint to soak up the cleaning fluid by capillary action. Aerosol sprays are not used because the propellants cause bubbles, which interfere with capillary action.

Long life, low interfacial tension oil, for example fluorosilicone oil, is applied to the joint immediately after cleaning. The oil must be miscible with the cleaner. The oil is drawn into crevices by diffusion through the cleaner. This forms concentration gradients which draw the oil into the grease matrix.

The process is more clearly defined through the following steps: (1) apply cleaner to the joint until it begins to flood out the sides, Block 12; (2) repeat two to three times to thoroughly clean the part, giving five to thirty seconds between applications for capillary uptake, Block 13; (3) apply oil until it begins to run down the sides, Block 14; (3) repeat two or more times to ensure adequate oil has been added, Block 16; (4) test the mechanism to ensure that the breaker times properly (test to make sure the breaker operates within specified time limits), Block 17; and (5) repeat entire process if necessary, Block 18.

Testing was performed using the cleaner and method of the current invention. The tests were performed using field aged bearings and a mechanical device having a solenoid-powered linkage to simulate a tripped circuit breaker. To determine the effectiveness of relubrication processes, several unused bearings were lubricated with popular greases to determine acceptable trip times. After several tests with trip times varying between 47 and 68 milliseconds, it was concluded that anything above 70 milliseconds was a slow trip.

For each test, the bearings were aged in a 140 degrees Celsius oven to rapidly age and oxidize lubricants in the bearing to failure. After oxidation, various techniques were used and tested. While several cleaners and techniques resulted in varying results such as no trip and trip times above 200 milliseconds, it was found that the inventive cleaner was able to provide consistent trip times and a higher degree of success. See Table 2.

TABLE 2

| Trip Time (DNT = Did Not Trip) | |
|---|---|
| | Process - Steps Preceding Test (Using Cleaners such as ZEP ID RED) |
| DNT | |
| DNT | Clean with ZEP ID RED or Equivalent |
| DNT | Clean with ZEP ID RED or Equivalent |
| DNT | Cleaner, EZ Reach, Cleaner, EZ Reach, Wait 5 Minutes |
| DNT | |
| DNT | |
| DNT | Clean, Lube, Manually Move 2X |
| 100 | Clean, Lube, Manually Move 2X |
| 103 | |
| 98 | |
| 101 | |
| 249 | |
| 131 | |
| 160 | |
| 132 | |
| 184 | |
| 147 | |
| 111 | |
| 115 | |
| 135 | |
| 610 | |
| | Process - Steps Preceding Test (Using Cleaner of Current Invention) |
| 218 | |
| 67 | Clean with Inventive Cleaner |

TABLE 2-continued

| Trip Time (DNT = Did Not Trip) | |
|---|---|
| 75 | |
| 69 | |
| 67 | |
| 63 | |
| 159 | Oven Aged 2 Days at 140° C., Cooled to −40° C. |
| 75 | |
| 64 | |
| 80 | |
| 79 | |
| 65 | Clean with Inventive Cleaner and Lube with FS-1265 Fluorosilicone Fluid |
| 83 | |
| 90 | |
| 61 | |
| 67 | |
| 72 | |

As shown in Table 2, the use of the inventive cleaner not only provided a more stable trip time, but also required less work on the part of the operator, i.e. manually moving the mechanism.

The foregoing has described a cleaner and method for maintaining bearings, bushings, linkage pins and chains used in various types of machinery, including industrial machinery. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

We claim:

1. A cleaner effective to rejuvenate spent grease, consisting essentially of, by approximate weight percent, 40% to 90% silicone, 10% to 50% acetone, and trace 5% alkylphenol ethoxylate.

2. A method for maintaining bearings, bushings, linkage pins and chains used in various types of machinery, comprising the steps of:

(a) providing a cleaner consisting essentially of, by approximate weight percent, 40% to 90% silicone, 10% to 50% acetone, and trace to 5% alkylphenol ethoxylate;

(b) applying the cleaner to a joint of a piece of machinery;

(c) applying oil to the joint;

(d) testing joint to ensure proper timing; and (e) repeating steps (a) through (d) if necessary.

3. The method according to claim 2, wherein the cleaner is applied to the joint until it floods out sides of the joint.

4. The method according to claim 2, further including the step of repeating step (b) to thoroughly clean the joint.

5. The method according to claim 4, further including the step of waiting five to thirty seconds between repeating step (b) to allow for capillary uptake of the cleaner into the joint.

6. The method according to claim 2, wherein the oil is applied to the joint until it begins to run down sides of the joint.

7. The method according to claim 2, further including the step of repeating step (c) to ensure adequate oil has been added to the joint.

* * * * *